US005957683A

United States Patent [19]

Yokoyama et al.

[11] Patent Number: 5,957,683

[45] Date of Patent: Sep. 28, 1999

[54] BURNER STRUCTURE USED FOR A PORTABLE GAS COOKING STOVE

[75] Inventors: Hiroaki Yokoyama; Toshikazu Ikarashi, both of Niigata, Japan

[73] Assignee: Snow Peak, Inc., Niigata, Japan

[21] Appl. No.: 09/163,002

[22] Filed: Sep. 30, 1998

[30] Foreign Application Priority Data

Sep. 30, 1997 [JP] Japan ..... 9-266584

[51] Int. Cl.[6] ..... F23D 14/28

[52] U.S. Cl. ..... 431/344; 126/39 R

[58] Field of Search ..... 431/344, 329; 126/38, 39 R

[56] References Cited

U.S. PATENT DOCUMENTS

| | | | |
|---|---|---|---|
| 2,363,099 | 11/1944 | Tullis | 431/344 |
| 5,573,393 | 11/1996 | Tsai | 431/344 |

FOREIGN PATENT DOCUMENTS

| | | |
|---|---|---|
| 127328 | 1/1902 | Germany . |
| 202884 | 10/1908 | Germany . |
| 474130 | 3/1929 | Germany . |
| 7-233948 A2 | 9/1995 | Japan . |
| 7-233948 | 9/1997 | Japan . |
| 2272283 | 5/1994 | United Kingdom . |

*Primary Examiner*—Carroll B. Dority
*Attorney, Agent, or Firm*—Griffin, Butler, Whisenhunt & Szipl, LLP

[57] ABSTRACT

There is provided a burner structure used for a portable gas cooking stove, including a mixing tube with an open end from which a mixture gas of a combustible gas and air is discharged, a burner head with a predetermined volume, an open bottom surface, and a top surface with at least one opening, an inner cup having a size that enables the inner cup to be housed in the burner head, and an open bottom surface, and a bottom plate with a through-hole through which the mixing tube can be inserted, covering the open bottom surface of the burner head, wherein the inner cup is installed inside the burner head in such a manner that an inner surface of the inner cup faces the mixing tube, and the mixing tube is installed on the bottom plate so that the open end is positioned higher than a bottom surface of the inner cup. The burner structure decreases the flow rate of the gas mixture before the gas is discharged out of the burner structure, and when the gas is discharged out of the burner structure, the flow rate of the gas is substantially the same as the normal combustion rate. Therefore, the burner structure for a portable gas cooking stove can effectively prevent the occurrence of lift that may take place if the flow of the gas mixture is excessive, so all the gas mixture can be burned completely.

10 Claims, 2 Drawing Sheets

BURNER STRUCTURE USED FOR A PORTABLE GAS COOKING STOVE

BACKGROUND OF THE INVENTION

1. Field of the Invention

The present invention relates to a so-called outdoor portable gas cooking stove, and more particularly, to the burner structure of a portable gas cooking stove.

2. Description of the Related Art

FIG. 1 shows an example of a portable gas cooking stove known in the prior art. Normally, the portable gas cooking stove 10 includes a gas cartridge 11 filled with compressed combustible gas, and a gas burner 12 mounted detachably on the gas cartridge 11. The gas cartridge 11 and the gas burner 12 are installed in a hermetically sealed state by the gasket 13.

The gas burner 12 is connected to the gas cartridge 11 and the connection has a plug fitting 14 through which combustible gas supplied from the gas cartridge 11 passes, a gas flow adjusting spindle 15 that adjusts the flow of the combustible gas passing through the plug fitting 14, by adjusting the degree of opening of a gas passage formed inside the plug fitting 14, a burner head 16 with a number of openings 16*a* formed on the surface, a mixing tube 17 connecting the plug fitting 14 to the burner head 16, and kettle holders 18 that are fixed on the mixing tube 17 and extend over the burner head 16.

Combustible gas in a pressurized state enters from the gas cartridge 11 into the plug fitting 14, and the flow of the gas is adjusted by the gas flow adjusting spindle 15, and then the gas enters the mixing tube 17. The mixing tube 17 is provided with a number of openings 17*a,* and by virtue of the negative pressure produced when the combustible gas passes through the mixing tube 17, external air is drawn in through the openings 17*a* into the mixing tube 17. The combustible gas is mixed with air entering through the openings 17*a,* into a gas mixture of the combustible gas and air.

After the gas mixture enters the interior of the burner head 16, the gas is discharged through the openings 16*a* and ignited by an appropriate means (not illustrated) such as an electric igniter. Flames of the ignited, burning gas mixture heat an object to be heated (a pan, kettle, food, etc.) put on the kettle holders 18.

Ordinary outdoor appliances, not limited only to portable gas cooking stoves, are required to be small. Regarding a portable gas cooking stove, the size of the gas cartridge 11 cannot be made smaller than a practical limit determined by the volume of gas contained in the cartridge to maintain a gas-burning time required for practical applications. Consequently, for a portable gas cooking stove, miniaturization has been focused mainly on the gas burner 12, and more particularly, the burner head 16.

However, if the burner head 16 is simply reduced in size, the flow of the gas mixture may exceed the proper gas burning rate, because the volume of the burner head 16 becomes small compared to the gas flow from the gas cartridge 11, resulting in a greater flow of the gas mixture discharged through the openings 16*a* of the burner head 16.

As long as the velocity of the gas mixture is smaller than the proper burning rate of the gas, the gas mixture is burned completely. In this condition, flames start from the surface of the burner head. If the gas flow rate of the gas mixture exceeds the proper gas burning rate, on the other hand, a phenomenon called "lift" occurs. Lift is a phenomenon in which a flame does not start from the surface of a burner head, but from a place slightly separated from the surface of the burner head. Once lift occurs, all the gas mixture is not burned completely, and part of the gas mixture is discharged from the openings 16*a* of the burner head, in a state of incomplete combustion.

To solve these problems, many solutions have been proposed. FIG. 2 shows a burner structure described in Japanese Unexamined Patent Publication 7-233948, as one of the solutions.

This burner is structured substantially in the form of a truncated cone, and includes a perforated plate 20 with an open bottom surface and a side wall provided with a number of openings 20*a,* and a bottom plate 21 that closes the open bottom surface of the perforated plate 20, and is provided with a through-hole 21*a* at the center, through which a mixing tube 17 is inserted, and a partition plate 22 provided with a gas discharge hole 22*a* at the center, formed in a substantially similar truncated cone shape as the perforated plate 20. The three plates, i.e. the perforated plate 20, the bottom plate 21 and the partition plate 22 are crimped together and are integrated into a body by folding over the outer periphery of the perforated plate 20. The partition plate 22 is arranged so as to form a gap 23 between it and the perforated plate 20.

The burner structure disclosed in the above-mentioned Publication shown in FIG. 2 works as follows.

By combining the three plates, the perforated plate 20, the bottom plate 21 and the partition plate 22, a rather large diffusion space 24 is formed between the bottom plate 21 and the partition plate 22, and a relatively narrow gap 23 is established between the partition plate 22 and the perforated plate 20.

The gas mixture flowing out of the mixing tube 17 first enters the diffusion space 24 where the gas diffuses. As a result, the velocity of the gas mixture decreases, and the combustible gas and air are mixed further.

After that, the gas mixture in the diffusion space 24 passes through the gas outlet hole 22*a* in the partition plate 22 into the gap 23 along which the gas mixture flows, and the mixture is discharged to the outside from the openings 20*a*. By adjusting the size of the gas outlet hole 22*a* in the partition plate 22, the velocity at which the gas mixture enters the gap 23 can be adjusted. That is, if the gas outlet hole 22*a* is made larger, the flow of the gas mixture increases, and vice versa. The pressure of the gas mixture becomes uniform as the gas passes through the gap 23, and the gas is discharged from all the openings 20*a* evenly.

According to the burner structure disclosed in the above-mentioned Publication, the gas mixture diffuses first in the diffusion space 24, and the velocity is decreased, and after that, the pressure becomes uniform in the gap 23. As a result, the velocity of the gas mixture when it is discharged from the openings 20*a* is further reduced and approaches the burning rate. As a consequence, it is considered that the gas mixture will not be discharged in an unburned state.

With the burner structure specified in the above-mentioned Publication, it is assumed that the gas mixture flowing out of the mixing tube 17 is diffused in the diffusion space 24.

However, the gas outlet hole 22*a* provided in the partition plate 22 is located just in front of the open end of the mixing tube 17, and furthermore, the gas mixture being discharged from the mixing tube 17 has a high velocity. As a result, the gas mixture flowing out of the mixing tube 17 is actually discharged directly into the gap 23 from the gas outlet hole 22*a*. In other words, the gas mixture flows out into the gap 23 without being diffused in the diffusion space 24.

Therefore, even the burner structure described in the above-mentioned Publication cannot reduce the velocity of the gas mixture satisfactorily if the burner structure is made compact, so the problem of discharging an unburned gas mixture cannot be solved practically.

SUMMARY OF THE INVENTION

The present invention has been achieved with the aim of solving the problems of a conventional burner structure used for a portable gas cooking stove. It is an object of the present invention to provide a burner structure that can reduce the velocity of the gas mixture of a combustible gas and air to give a satisfactory combustion rate, and can prevent the gas mixture from being discharged from the burner in an unburned state.

There is provided a burner structure for a portable gas cooking stove, including a mixing tube with an open end from which a gas mixture of a combustible gas and air is discharged, a burner head with a predetermined volume, an open bottom surface, and a top surface with at least one opening, an inner cup having a size that enables the inner cup to be housed in the burner head, and an open bottom surface, and a bottom plate with a through-hole through which the mixing tube can be inserted, covering the open bottom surface of the burner head, wherein the inner cup is installed inside the burner head in such a manner that an inner surface of the inner cup faces to the mixing tube, and the mixing tube is installed in the bottom plate so that the open end is positioned higher than a bottom of the inner cup. In this burner structure, the inner cup is installed inside the burner head in such a manner that the inner surface of the inner cup faces the mixing tube. Also, the mixing tube is installed in the bottom plate so that an open end thereof is positioned higher than a bottom of the inner cup.

In the above-mentioned burner structure, the mixing tube is installed facing the top of the inner surface of the inner cup. Therefore, the gas mixture discharged from the open end of the mixing tube is deflected at the inner surface of the inner cup, and changes its direction of flow for the first time. Then, the gas moves downwards along the inner surface of the inner cup. The gas mixture, flowing out of the inner cup, impinges on the bottom plate and changes its direction for the second time, and rises inside the space formed between the outer surface of the inner cup and the inner wall of the burner head. After that, the gas mixture is discharged out of the openings formed in the burner head, and is ignited by a suitable means of ignition.

In the above-mentioned burner structure, the gas mixture discharged from the mixing tube is forced to change its direction of flow twice when it is deflected by the inner cup and the bottom plate.

After the gas mixture is discharged from the mixing tube, it flows downwards along the inner wall of the inner cup, and then rises along the inside of the burner head to the openings provided in the surface of the burner head, so the gas travels over a distance equal to the sum of the height of the inner cup and the distance from the bottom of the burner head to the openings. This distance is longer than that traveled by the gas mixture in the conventional burner structure shown in FIG. 2. As a consequence, the velocity of the gas mixture gradually decreases as it flows along this path, and when it is discharged from the openings constructed in the surface of the burner head, the flow of the gas mixture is substantially equal to that required to give a suitable combustion rate.

Therefore, the gas mixture does not cause any lift, and is burned completely without discharging any unburned gas mixture.

The inner cup should preferably be arranged so that its lower edge is located below the lowest part of the openings in the burner head.

In this arrangement, the gas mixture moves downwards along the inner surface of the inner cup after its direction of flow was changed for the first time, and then the gas impinges on the bottom plate, so that the gas mixture is forced to change its direction of flow for the second time.

Although the openings formed in the surface of the burner head can be shaped freely, it is preferred that the opening is comprised of a number of elongate holes extending in a height-wise direction of the burner head, so that the total area of the elongate holes is large.

A mesh-like net can be used to cover each opening formed in the surface of the burner head.

When the gas mixture contacts the mesh-like net, the flow velocity of the gas mixture is decreased further. The mesh-like net can be installed either outside or inside the openings.

The shapes of the burner head and inner cup are not limited specifically. Instead, the head and the cup can be shaped freely. For instance, the burner head can be formed in the shape of a truncated cone, and the cup can have a hemispherical shape.

The advantages obtained by the aforementioned present invention will be described hereinbelow.

The burner structure of a portable gas cooking stove according to the present invention decreases the flow rate of the gas mixture before the gas is discharged out of the burner structure, and when the gas is discharged out of the burner structure, the flow rate of the gas is substantially the same as the normal combustion rate. Therefore, the burner structure for a portable gas cooking stove can effectively prevent the occurrence of lift that may take place if the flow of the gas mixture is excessive, so all the gas mixture can be burned completely.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 3:
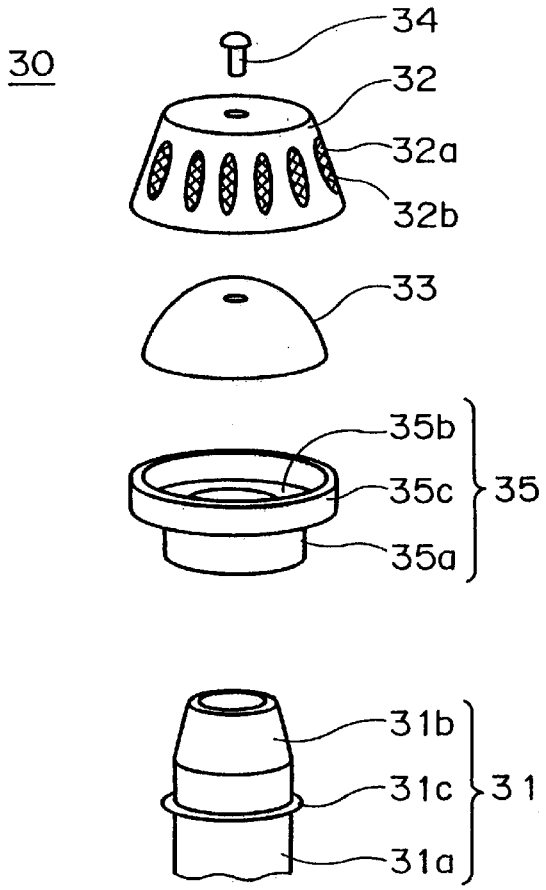
FIG. 3 is an exploded perspective view of a burner in accordance with a preferred embodiment of the present invention.
Figure 4:
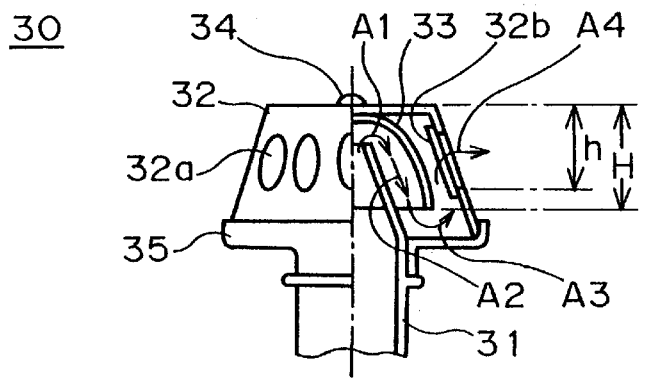
FIG. 4 is a front (left half) and cross-sectional (right half) view of an assembled burner illustrated in FIG. 3.

FIGS. 3 and 4 show a preferred embodiment of the burner structure for a portable gas cooking stove, according to the present invention. This embodiment is illustrated only for the burner structure (and is concerned only with the structure corresponding to the mixing tube 17 and the burner head 16 of the gas cooking stove shown in FIG. 1), and the construction of the other portions is the same as that of the gas cooking stove described in FIG. 1.

As shown in FIG. 3, the mixing tube 31 of this embodiment includes a cylindrical portion 31*a* and a tapered portion 31*b* shaped like a truncated cone, and at a predetermined location on the cylindrical portion 31*a*, a ring-shaped portion 31*c* with an enlarged diameter is formed.

The burner head 32 in this embodiment is shaped substantially as a truncated cone with an open bottom. A number of openings 32*a* are provided in the side wall of the burner head spaced at equal intervals around the circumference, and each opening 32*a* is a long hole that extends in the vertical direction of the burner head 32. In addition, a mesh-like net 32*b* covers the inside of each opening 32*a* (see FIG. 4).

Inside the burner head 32, an inner cup 33 is installed. The inner cup 33 is substantially hemispherical, with a diameter smaller than that of the burner head 32, and with an open bottom. The inner cup 33 is attached to the inner surface of the top of the burner head 32 by means of a rivet 34 passing through small holes provided in the tops of the burner head 32 and the inner cup 33.

Figure 2:
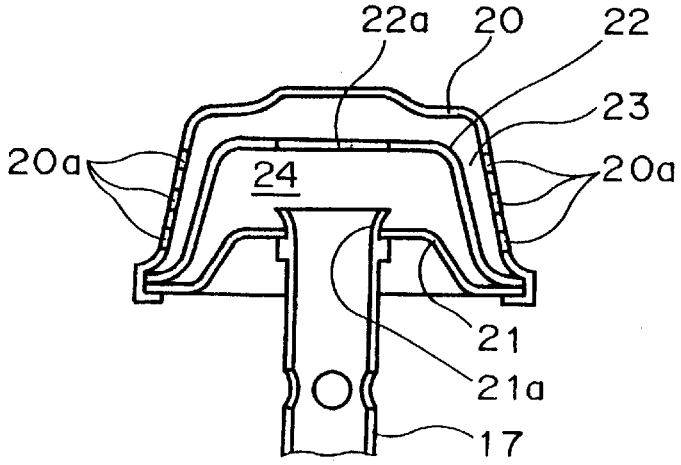
FIG.2 PRIOR ART
FIG. 2 is a cross-sectional view of a burner used in the gas cooking stove illustrated in FIG. 1.

In this embodiment, the height H of the inner cup 33 is smaller than that of the burner head 32, but as shown in FIG. 2, the height H is predetermined so that it is greater than the length h from the top surface of the burner head 32 to the bottom point of the openings 32*a*. More explicitly, the inner cup 33 is arranged so that its lower rim is located below than the bottom point of the openings 32*a* of the burner head 32.

The top portion of the inner cup 33 is fixed to the burner head 32 with the rivet 34 in the present embodiment, however as long as the bottom rim of the inner cup 33 is located below the bottom point of the openings 32*a* of the burner head 32, the inner cup 33 can also be installed with a gap between it and the burner head 32.

A bottom plate 35 is installed at the open bottom of the burner head 32.

The bottom plate 35 includes a mixing tube mounting portion 35*a* with an inner diameter equal to the outer diameter of the cylindrical portion 31*a* of the mixing tube 31 and a flange portion 35*b* for mounting the burner head 32. At the center of the flange portion 35*b*, an opening with the same diameter as that of the mixing tube mounting portion 35*a* is provided, and the flange portion 35*b* is formed integrally with the mixing tube mounting portion 35*a*. The outer diameter of the flange portion 35*b* is equal to the outer diameter of the open bottom of the burner head 32, and a vertical lip 35*c* is provided at the outer periphery of the flange portion 35*b*. As shown in FIG. 4, the burner head 32 is fixed on the flange portion 35*b* of the bottom plate 35, by being surrounded by the vertical lip 35*c*.

In FIG. 4, the mixing tube 31 is inserted into the mixing tube mounting portion 35*a* of the bottom plate 35, until the mixing tube mounting portion 35*a* butts against the ring shaped portion 31*c* with an enlarged diameter. At this portion, the dimensions of the mixing tube 31, the burner head 32, the inner cup 33 and the bottom plate 35 have been predetermined so that the top end of the mixing tube 31 is located higher than the bottom rim of the inner cup 33.

The burner structure with the aforementioned construction based on this embodiment functions as follows.

In FIG. 4 that shows the burner structure according to the present embodiment, the mixing tube 31 is installed so it faces towards the top portion of the inner surface of the inner cup 33, and is installed so that the top end of the mixing tube 31, that is, the open end is located higher than the bottom rim of the inner cup 33. Therefore, the gas mixture flowing out of the open end of the mixing tube 31 impinges against the top portion of the inner surface of the inner cup 33, and changes its direction of flow for the first time as shown by the arrow A1.

Next, the gas mixture passes down inside the space formed by the outer wall of the tapered portion 31*b* of the mixing tube 31 and the inner surface of the inner cup 33, as shown by the arrow A2.

As described before, the height H of the inner cup 33 is predetermined to be greater than the height h from the top portion of the burner head 32 to the bottom portion of the openings 32*a*, therefore the bottom rim of the inner cup 33 is positioned below the bottom portion of the openings 32*a* in the burner head. As a result, when the gas mixture flows out of the inner cup 33, it impinges against the flange portion 35*b* of the bottom plate 35, and as shown by the arrow A3, the gas changes its direction of flow for the second time. After that, the gas mixture rises inside the space formed by the outer surface of the inner cup 33 and the inner wall of the burner head 32, and eventually as shown by the arrow A4, the gas is discharged out of the openings 32*a* through the mesh-like nets 32*b*.

Figure 1:
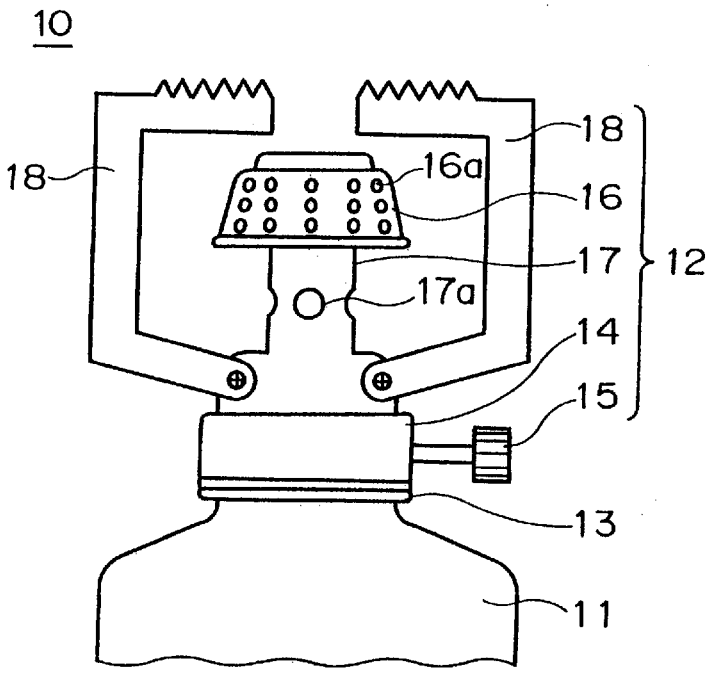
FIG.1 PRIOR ART
FIG. 1 is a front view of a conventional portable gas cooking stove.

The gas mixture, discharged out of the burner structure in this way, is ignited by a suitable means of ignition (not illustrated), and heats an object to be heated which is placed on the kettle holders (see FIG. 1).

According to the burner structure of this embodiment described above, the gas mixture first changes its direction of flow for the first time when it impinges on the inner surface of the inner cup 33 (see the arrow A1), and the gas changes the direction of flow for the second time when it impinges on the flange portion 35*b* of the bottom plate 35 (see the arrow A3). As a result of changing directions twice, the velocity of the gas mixture decreases considerably, and when the gas is discharged out of the burner structure, the flow of the gas mixture becomes substantially the same as the combustion rate.

In addition, as shown by the arrows A1 to A4, the gas mixture is discharged from the mixing tube 31, and before the gas is discharged out of the openings 32*a* in the burner head 32, the gas changes its direction of flow for the first time, and then the gas descends along the inner surface of the inner cup 33, and after the second change of direction of flow takes place, the gas rises up to the openings 32*a* in the burner head 32. Consequently, the gas mixture travels a distance at least equal to the sum of the height of the inner cup 33 and the distance from the plane of the burner head 32 to the openings 32*a*. This distance is greater than the distance traveled by the gas mixture in the conventional burner structure shown in FIG. 2. Because the gas mixture travels over this rather long distance together with the two changes of direction mentioned above, the velocity of the gas mixture is surely decreased.

Furthermore, as the gas mixture passes through the mesh-like nets 32*b*, the velocity of the gas mixture is further reduced.

In this way, the flow rate of the gas mixture is decreased assuredly by the three factors of the two changes of direction, the rather long distance traveled, and by passing through the nets 32*b*, so that when the gas is discharged from the openings 32*a* in the burner head 32, the flow of the gas is substantially appropriate to maintain normal combustion. Accordingly, the discharge of unburned gas mixture, caused by an excessive flow of the gas, can be prevented, therefore the gas mixture can be burned completely.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-266584 filed on September 30, 1997 including specification, claims, drawings and summary is incorporated herein by reference in its entirety.

What is claimed is:

1. A burner structure used for a portable gas cooking stove, comprising:

a mixing tube with an open end from which a mixture gas of a combustible gas and air is discharged;

a burner head with a predetermined volume, an open bottom surface, and a top surface with at least one opening;

an inner cup having a size that enables said inner cup to be housed in said burner head, and an open bottom surface; and a bottom plate with a through-hole through which said mixing tube can be inserted, covering said open bottom surface of said burner head, wherein said inner cup is installed inside said burner head in such a manner that an inner surface of said inner cup faces said mixing tube, and said mixing tube is installed on said bottom plate so that an open end thereof is positioned higher than a bottom of said inner cup.

2. The burner structure as set forth in claim 1, wherein said inner cup is installed in such a manner that a lower edge thereof is lower than a bottom of said opening.

3. The burner structure as set forth in claim 1, wherein said opening comprises a plurality of elongate holes extending in a height-wise direction of said burner head.

4. The burner structure as set forth in claim 1, further comprising a mesh-like net placed across at said opening.

5. The burner structure as set forth in claim 1, wherein said burner head is formed substantially in the shape of a truncated cone.

6. The burner structure as set forth in claim 1, wherein said inner cup is formed in a hemispherical shape.

7. The burner structure as set forth in claim 2, wherein said opening comprises a plurality of elongate holes extending in a height-wise direction of said burner head.

8. The burner structure as set forth in claim 2, further comprising a mesh-like net placed across at said opening.

9. The burner structure as set forth in claim 2, wherein said burner head is formed substantially in the shape of a truncated cone.

10. The burner structure as set forth in claim 2, wherein said inner cup is formed in a hemispherical shape.

* * * * *